US011414235B2

(12) United States Patent
Greene et al.

(10) Patent No.: US 11,414,235 B2
(45) Date of Patent: Aug. 16, 2022

(54) CONSUMER PRODUCT PACKAGE AND METHOD OF ASSEMBLY

(71) Applicant: The Gillette Company LLC, Boston, MA (US)

(72) Inventors: Jeffrey Allen Greene, Milton, MA (US); Matthew James Helle, Cambridge, MA (US)

(73) Assignee: The Gillette Company LLC, Boston, MA (US)

( * ) Notice: Subject to any disclaimer, the term of this patent is extended or adjusted under 35 U.S.C. 154(b) by 0 days.

(21) Appl. No.: 17/112,516

(22) Filed: Dec. 4, 2020

(65) Prior Publication Data

US 2022/0177181 A1 Jun. 9, 2022

(51) Int. Cl.
*B65D 5/42* (2006.01)
*B65D 5/02* (2006.01)

(52) U.S. Cl.
CPC ..... *B65D 5/4208* (2013.01); *B65D 5/0227* (2013.01)

(58) Field of Classification Search
CPC .. B65D 5/4208; B65D 5/46088–46176; B65D 5/0227
USPC ..... 229/117.18, 117.09, 117.24, 117.14, 229/117.15, 102; 206/806
See application file for complete search history.

(56) References Cited

U.S. PATENT DOCUMENTS 1,577,556 A 3/1926 Samuel et al.
1,616,677 A 2/1927 Samuel
1,969,428 A 8/1934 Samuel
2,659,524 A * 11/1953 McElwee ..... B65D 5/18 206/193
2,833,457 A 5/1958 Tyrseck
2,874,870 A * 2/1959 Collura ..... B65D 71/30 206/141
2,900,124 A * 8/1959 Leone ..... B65D 5/46096 229/117.14
2,933,232 A * 4/1960 Bugnone ..... B65D 5/46096 229/117.14
3,074,614 A * 1/1963 Moffat ..... B65D 5/46088 229/117.15
3,394,863 A * 7/1968 Wood ..... B65D 71/0014 229/117.14
3,591,070 A * 7/1971 Vrana ..... B65D 5/46096 229/117.15
3,799,332 A 3/1974 Jeronimus
3,946,936 A 3/1976 Brown
4,207,978 A 6/1980 Patterson et al.
4,413,730 A 11/1983 Morse
4,447,004 A 5/1984 House et al.
4,468,212 A 8/1984 Jennings
(Continued)

FOREIGN PATENT DOCUMENTS

DE 9305418 U1 * 8/1993 ..... B65D 5/4208
EP 1109730 A1 6/2001
KR 100885978 B1 * 3/2009

*Primary Examiner* — Nathan J Newhouse
*Assistant Examiner* — Phillip D Schmidt
(74) *Attorney, Agent, or Firm* — John M. Lipchitz

(57) ABSTRACT

A consumer product package with a sheet of formable material having a first hang tag portion defining a first hang tag opening, a second hang tag portion defining a second hang tag opening and a third hang tag portion defining a third hang tag opening. The sheet has a folded position with the first hang tag opening, second hang tag opening and third hang tag opening aligned.

8 Claims, 10 Drawing Sheets

(56) References Cited

U.S. PATENT DOCUMENTS

| | | | | |
|---|---|---|---|---|
| 4,948,036 | A * | 8/1990 | Loughman | B65D 71/30 206/427 |
| 5,117,973 | A | 6/1992 | Lo | |
| 5,263,586 | A | 11/1993 | Keable | |
| 5,363,981 | A | 11/1994 | Giblin et al. | |
| 5,713,472 | A | 2/1998 | Howell et al. | |
| 7,731,039 | B1 | 6/2010 | Minger et al. | |
| 2012/0012489 | A1* | 1/2012 | Mongan | B65D 5/4283 206/459.5 |

* cited by examiner

CONSUMER PRODUCT PACKAGE AND METHOD OF ASSEMBLY

FIELD OF THE INVENTION

The present invention relates to packages for consumer products and more particularly, to foldable consumer product packages.

BACKGROUND OF THE INVENTION

Consumer products are incorporating more innovation to provide consumers with improved user experiences. However, innovative consumer products are more expensive and thus are more likely to be stolen at the retail shelf by shoplifters. Shoplifters typically look for products that are compact, relatively expensive and can be sold for near-retail prices. For example, razors and razor blade cartridges are typically expensive, small in size, have a high resale value and are in high demand, especially for more premium brands. Similar to razors and razor blades, electric toothbrushes and their corresponding replacement heads are also commonly shoplifted items. Teeth whitening strips are another dental hygiene product with a high theft rate in retail stores. Furthermore, with the advancement of e-commerce the shoplifting industry is growing because of the increased ease of selling of stolen products over the internet.

Consumer product companies and retailers typically used plastic blister packages because they are more difficult for shoplifters to tear open. However, due to mounting global concerns about the environment, it has become desired for producers to adopt eco-friendly packaging. Plastic packages also frustrate legitimate consumers because of the difficulty of opening the package without the aid of a sharp tool. Accordingly, more packages are being designed with paper based materials. However, paper based packages are easier to rip open, especially when anti-theft tags are attached to the hang tag portion of the package. Despite the use of known packaging techniques, there remains a need to further modify consumer product packages to hamper product theft while also providing a more sustainable package.

SUMMARY OF THE INVENTION

In one aspect, the invention features, in general, a consumer product package having a sheet of formable material with a first hang tag portion defining a first hang tag opening, a second hang tag portion defining a second hang tag opening and a third hang tag portion defining a third hang tag opening. The sheet has a folded position with the first hang tag opening, the second hang tag opening and the third hang tag opening aligned.

In another aspect, the invention features, in general, a consumer package comprising a top face and a reinforced hang tag extending from the top face. The reinforce hang tag having a first hang tag portion defining a first hang tag opening, a second hang tag portion defining a second hang tag opening and a third hang tag portion defining a third hang tag opening. The second hang tag portion is positioned between the first hang tag portion and the third hang tag portion.

A sheet of formable material having a first hang tag portion defining a first hang tag opening and a second hang tag portion defining a second hang tag opening. A fold line is positioned between the first hang tag portion and the second hang tag portion. The sheet of formable material has a third hang tag portion defining a third hang tag opening and a fourth hang tag portion defining a fourth hang tag opening. A fold line is positioned between the third hang tag portion and the fourth hang tag portion. The sheet of formable material has a first panel, a second panel. A first top side portion is positioned between the second hang tag portion and the first panel. A second top side portion is positioned between the fourth hang tag portion and the second panel. A fold line positioned between the first top side portion and the first panel. A fold line is positioned between the second top side portion and the second panel.

DETAILED DESCRIPTION OF THE INVENTION

Figure 1A:
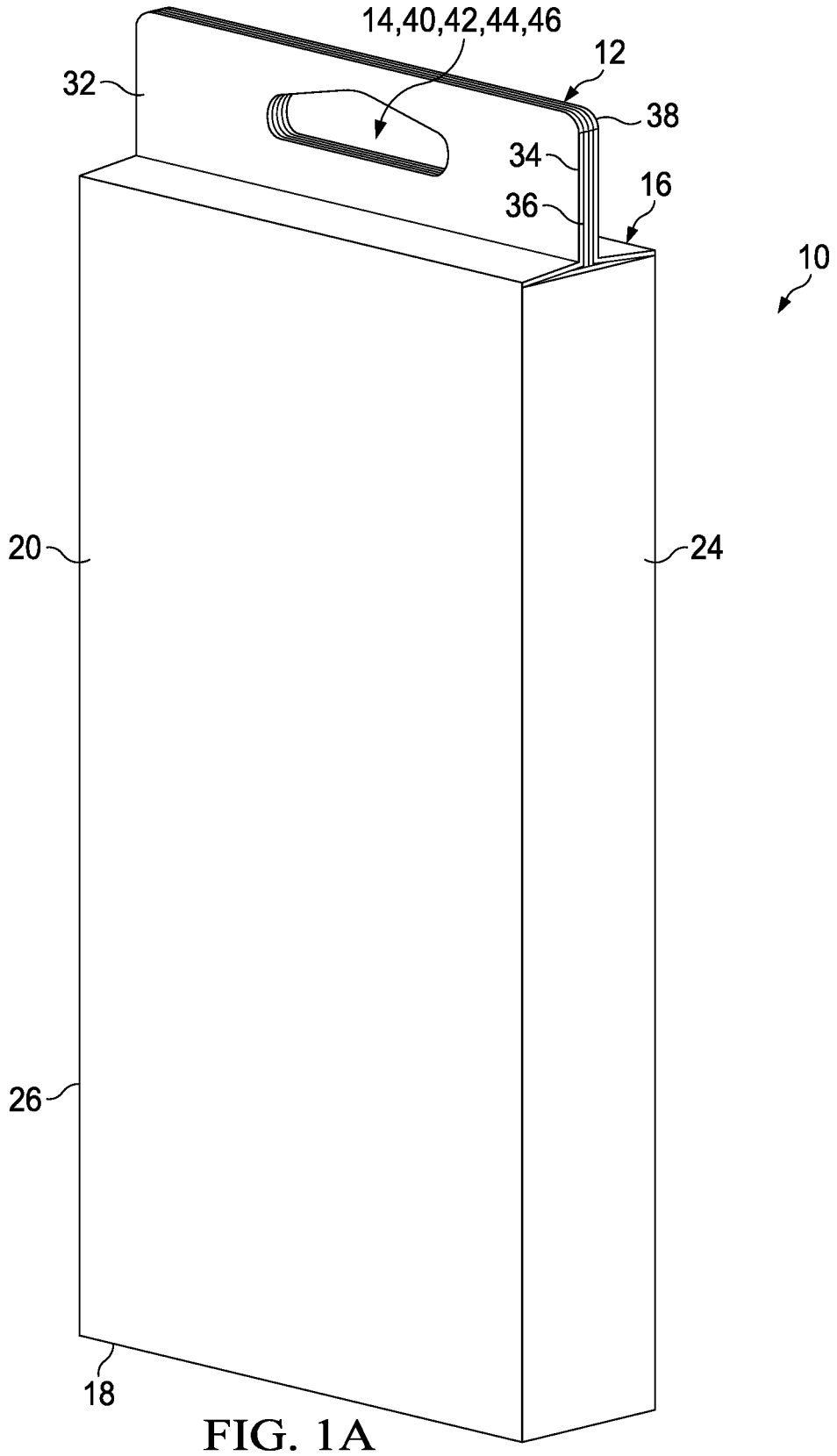
FIG. 1A is a first perspective view of one possible embodiment of consumer product package.
Figure 1B:
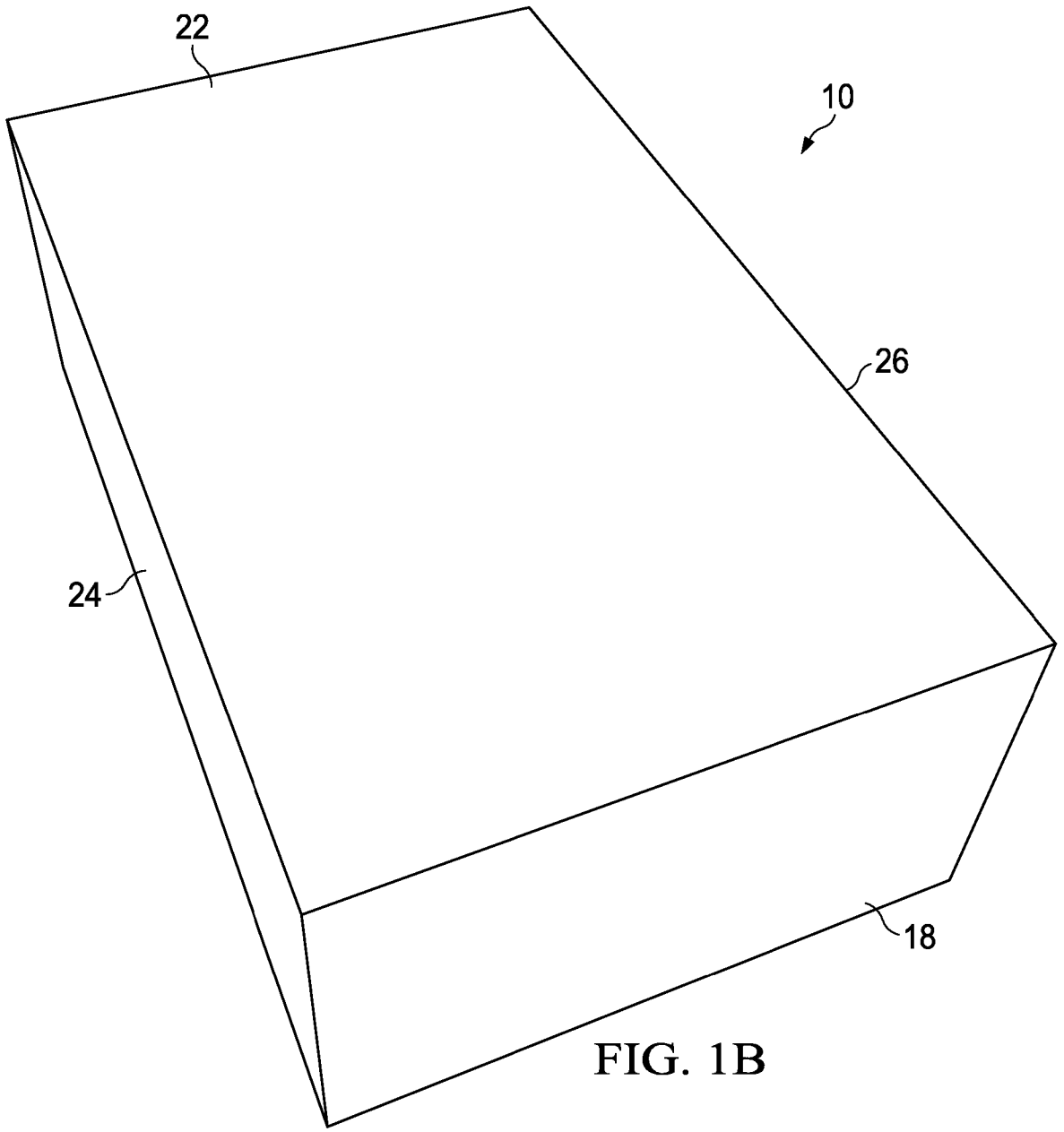
FIG. 1B is a second perspective view of the consumer product package of FIG. 1A.

Referring to FIGS. 1A and 1B, one possible embodiment of the present invention is shown illustrating a first and second perspective views of a consumer product package 10. As will be explained in greater detail below, the consumer product package 10 may be folded from a sheet of formable material to create a box-like shape to contain one or more consumer products. The consumer product package 10 may comprise a reinforced hang tag 12 having a reinforced hang tag hole 14. The hang tag hole 14 can be any shape, such as a circle, oval, triangle or rectangle. Although the hang tag hole 14 is illustrated as a bounded opening, the hang tag hole may be unbounded (e.g., a "J" or hook shape configuration). The reinforced hang tag 12 may extend from a top face 16 of the consumer product package 10. In certain embodiments, the reinforced hang tag 12 may be transverse to the top face 16. The consumer product package 10 may have a bottom face 18 opposite the top face 16. The consumer product package 10 may have a front face 20 and an opposing rear face 22 that are transverse to the top face 16 and the bottom face 18. A first side face 24 and a second side face 26 of the consumer product package 10 may be transverse to the bottom face 18, front face 20, top face 16 and rear face 22. As will be explained in greater detail below, the reinforced hang tag 12 may be constructed from several layers of material, for example, three layers, four layers or more. However, in certain embodiments, the various faces of the consumer product package 10 (the bottom face 18, side faces 24 and 26, top face 16, front face 20, rear face 22) may consist of only a single layer of material to save on material costs and complexity.

Figure 2:
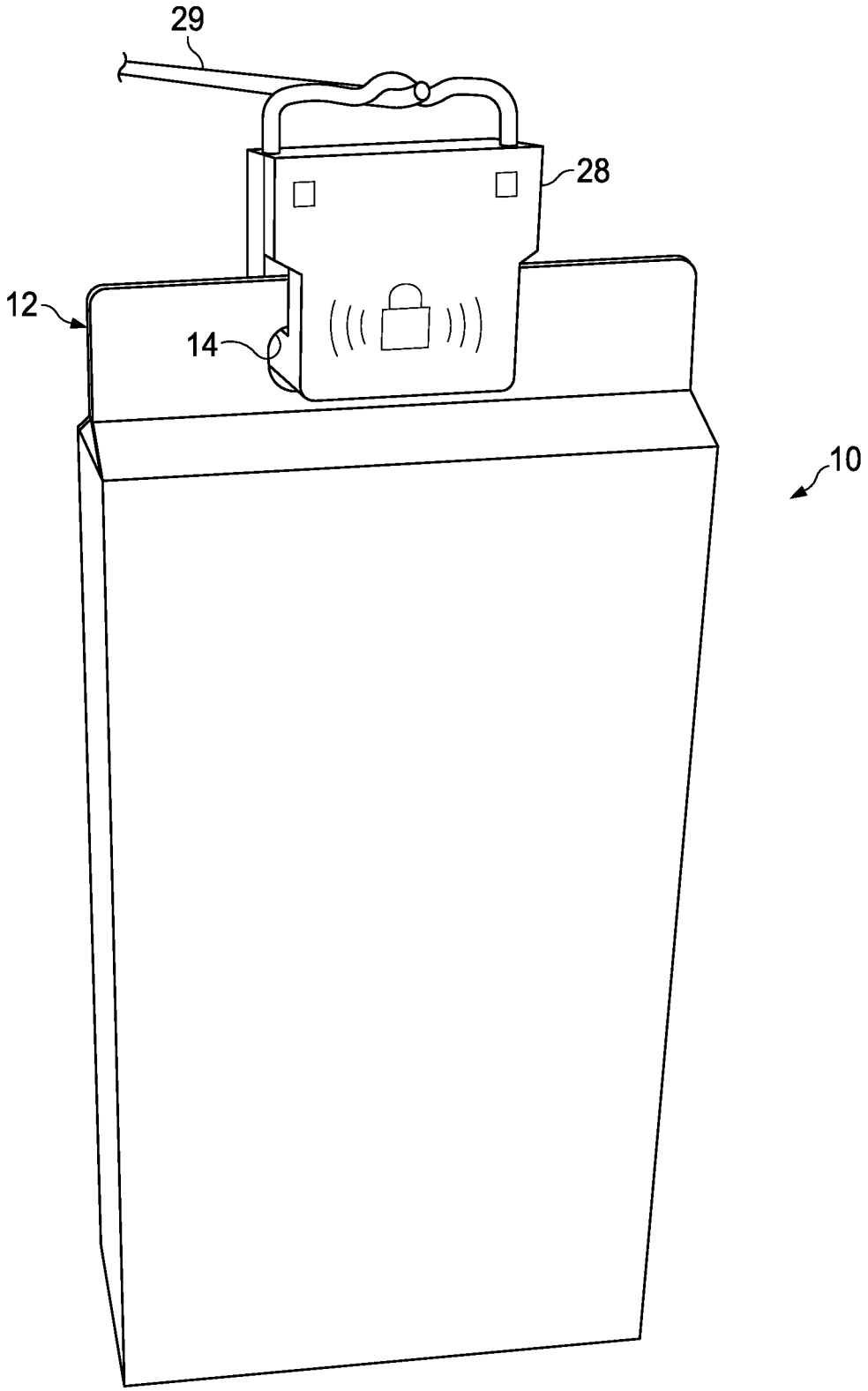
FIG. 2 is a perspective view of the consumer product package of FIG. 1A with a security tag.

The reinforced hang tag 12 may facilitate the unlawful removal of security devices attached to the reinforced hang tag structure 12, such as the security tag 28 shown in FIG. 2. In certain embodiments, the security tag 28 may be attached to the reinforced hang tag 12 through the reinforced hang tag hole 14. The security tag 28 may be removed by store personnel with a with a magnetic or mechanical key without damaging the consumer product package 10. If the consumer product package 10 leaves the store without first removing the security tag 28, the security tag 28 may trigger a store's anti-theft alarm system to notify store personnel. In certain embodiments, the security tag 28 may engage a display peg 29, but it is understood the consumer product package 10 may also be placed with the attached security tag 28 on a shelf rather than hanging on the display peg 29. Unauthorized removal of the security tag 28 may be more difficult with the reinforced hang tag 12 than other traditional consumer packages, especially if the package is made from sustainable materials, such as paperboard. Accordingly, the reinforced hang tag may comprise paperboard, but may even be equivalent in strength to traditional plastic blister packages.

An important property of consumer packaging is hang tag pull resistance. Three and four layer folded paperboard construction showed superior hang tag pull force resistance compared to one and two layer constructions from the same material and equivalent hang tag pull force resistance compared to typical plastic blister packages. Hang tag performance can be simulated in laboratory testing to measure the force required to remove the security tag 28 from the consumer product package 10. The security tag 10 may be affixed to a multi-dimensional force gauge. The consumer product package 10 may then be torn from the security tag 28 by a lab technician to obtain force gauge measurements, which may include a resulting peak force. The force measurements can then be used to compare different package designs. Three and four layer paperboard constructions have tested as strong or stronger as a traditional blister package construction having a plastic sheet with sealing card. Common one and two layer hang tag designs were not able to achieve the same removal force as blister packaging.

Figure 3:
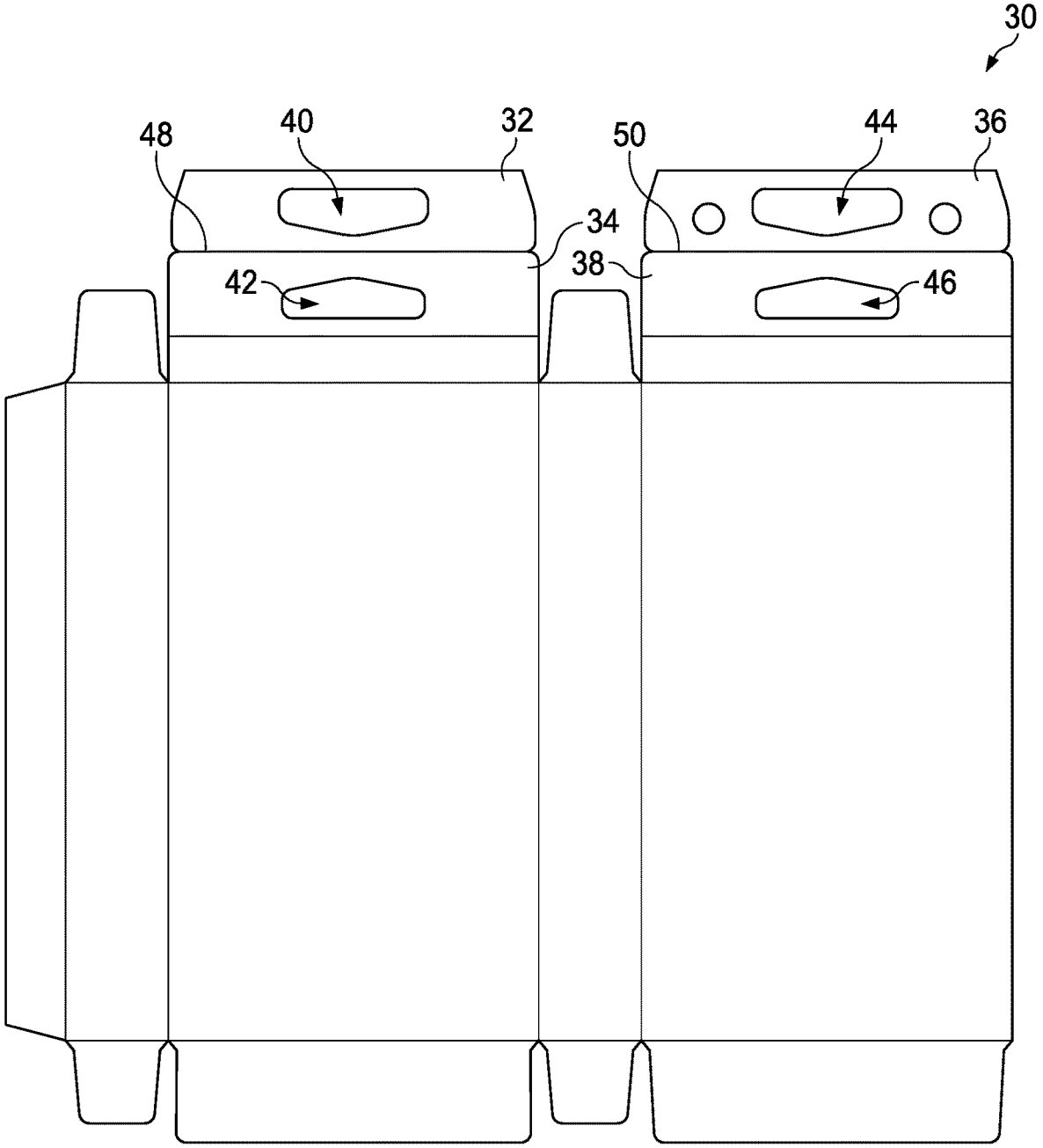
FIG. 3 is front view of a sheet of formable material.

Referring to FIG. 3, a front view of a sheet of formable material 30 is shown in an unfolded position. The sheet 30 of formable material may be die cut from a single sheet of material. The sheet of formable material 30 may comprise paperboard, containerboard, and or paper bags. The sheet 30 of formable material may include one or more cellulose-based products such as cardboard, paperboard, paper sheet, bamboo and other sustainable, compostable, biodegradable or recycled/recyclable materials. The sheet 30 of formable material may have one or more surfaces that are coated and/or have printed graphics. However, it is understood graphics may be applied at any step of the process. For example, labels may be applied to the consumer product package 10 (FIG. 1A) in lieu of or in addition two graphics printed directly on the sheet 30.

The sheet 30 may be folded, glued or otherwise secured into a final folded position resulting in the consumer product package 10, as shown in FIGS. 1A and 1B. In certain embodiments, the folding and gluing may be completed in multiple steps. For example, a first supplier may cut the sheet 30 and apply glue and fold certain portions of the sheet 30 before sending it to another location for final folding assembly location where the product is added. Alternatively, all the steps may be completed as part of a single operation.

The sheet 30 may include a first, second, third and fourth hang tag portions 32, 34, 36 and 38 that define a first, second third and fourth respective hang tag openings 40, 42, 44 and 46. As will be explained in further detail below, the four hang tag portions 32, 34, 36 and 38 may overlap each other and may be sealed together to form the reinforced hang tag structure 12 (FIG. 1A). In certain embodiments, the sheet 30 of formable material may have a thickness of about 0.3 mm to about 0.6 mm. Accordingly, the reinforced hang tag structure 12 (FIG. 1A) may result in a thickness of 1.2 mm to about 2.4, thus resulting in a much stronger construction. Furthermore, the adhesive applied in-between the various four hang tag portions 32, 34, 36 and 38 may further improve the strength of the hang tag structure 12.

A fold line 48 may be positioned between the first hang tag portion 32 and the second hang tag portion 34. It is understood that fold lines may include numerous different manufacturing options to make the assembly process easier. When forming and folding a carton, the folding steps may be facilitated by providing crease lines, cut lines, perforations, partial cuts, slit scores, pre-break, or a combination of these. The term fold line is used as a general description of any of these techniques which may be used to facilitate accurate folding along a predetermined path. There may also be a fold line 50 between the third hang tag portion 36 and the second hang tag portion 38.

Figure 4:
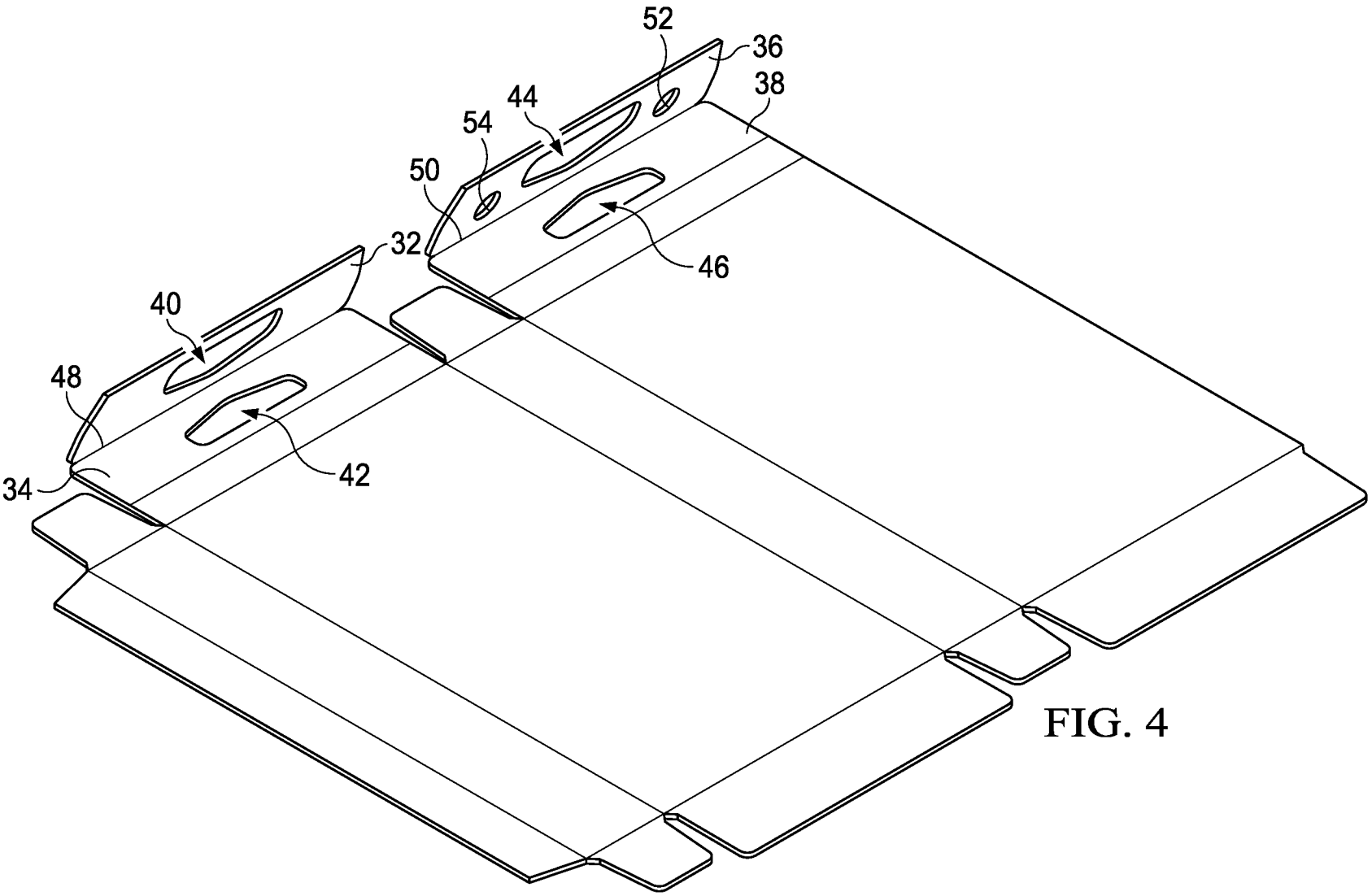
FIG. 4 is front view of the sheet of formable material in a folded position.
Figure 5:
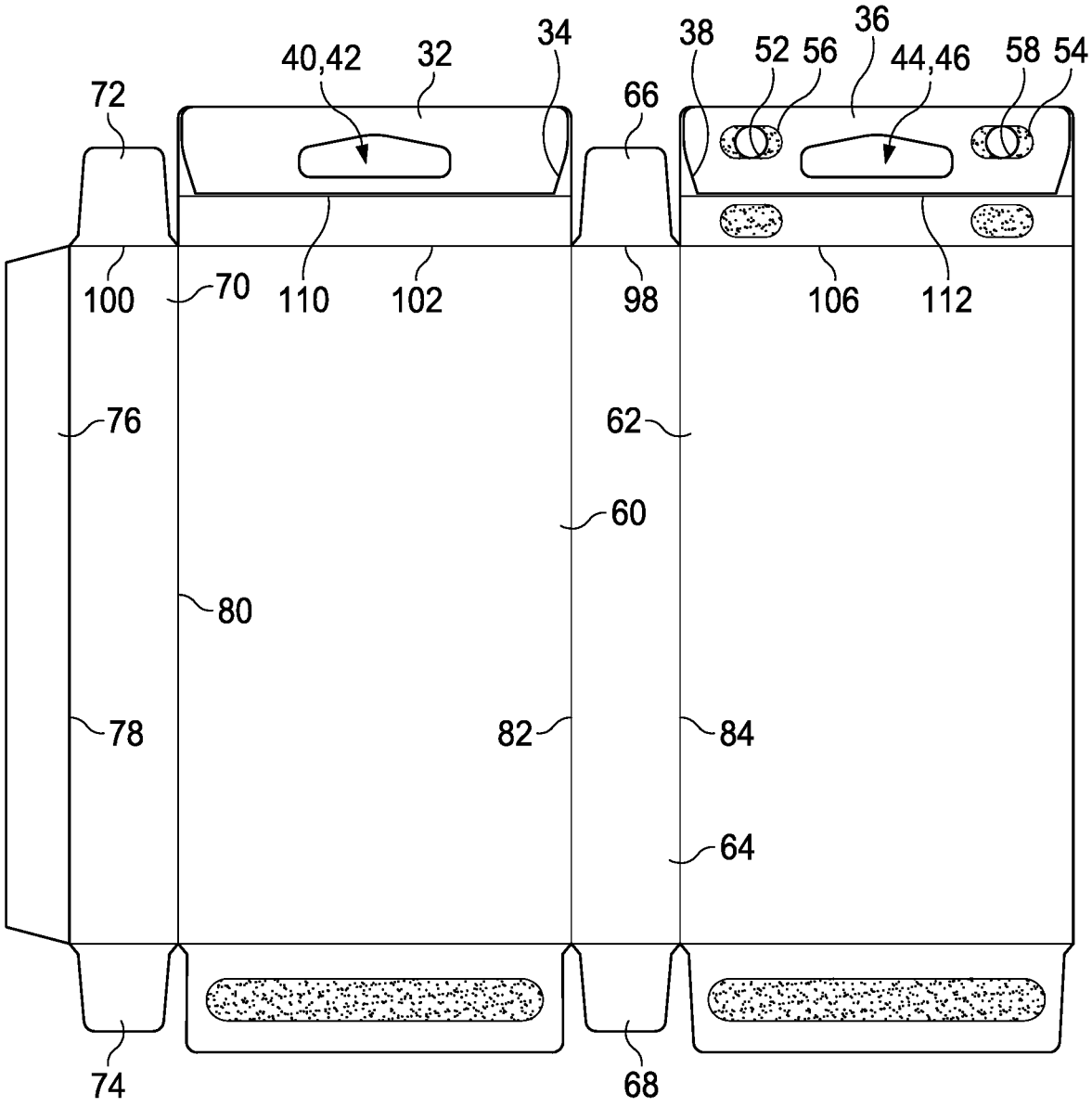
FIG. 5 is front view of the sheet of formable material in a folded position.

Referring to FIG. 4 a front view of the sheet 30 is illustrated with the first hang tag portion 32 and the third hang tag portion 36 being folded along the respective fold lines 48 and 50. FIG. 5 is a front view of the sheet 30 with the first hang tag portion 32 folded on top of the second hang tag portion 34 and the third hang tag portion 36 folded on top of the fourth hang tag portion 38. The fold lines 48 and 50 may facilitate the accurate placement of the respective hand tag portions 32, 34, 36 and 38. Accordingly, the hang tag opening 40 is aligned with the hang tag opening 42 and the hang tag opening 44 is aligned with hang tag opening 46, as shown in FIG. 5. In certain embodiments, an adhesive may be applied to the first hang tag portion 32 and/or the second hang tag portion 34 to seal them together. The sealing of the first and second hang tag portions 32 and 34 may improve the overall strength of the reinforced hang tag 14 (e.g., compared to just folding them together). Similarly, an adhesive may be applied to the third hang tag portion 36 and/or the fourth hang tag portion 38 to seal them together.

In certain embodiments, the third hang tag portion 36 may define one or more openings 52 and 54. The third hang tag opening 44 may be positioned between the pair of openings 52 and 54. As will be explained in greater detail below, when the third hang tag portion 36 is folded on top of the fourth hang tag portion 38, the fourth hang tag portion 38 may have one or more exposed areas 56 and 58 within the respective openings 52 and 54 to improve the strength of the reinforced hang hole 14. The geometry of the exposed areas 56 and 58 may include circular or oblong shapes of different radii and dimensions and may also include complex geometries such as a polymetric shapes, grid patterns, or mesh patterns to improve sealing.

Figure 6:
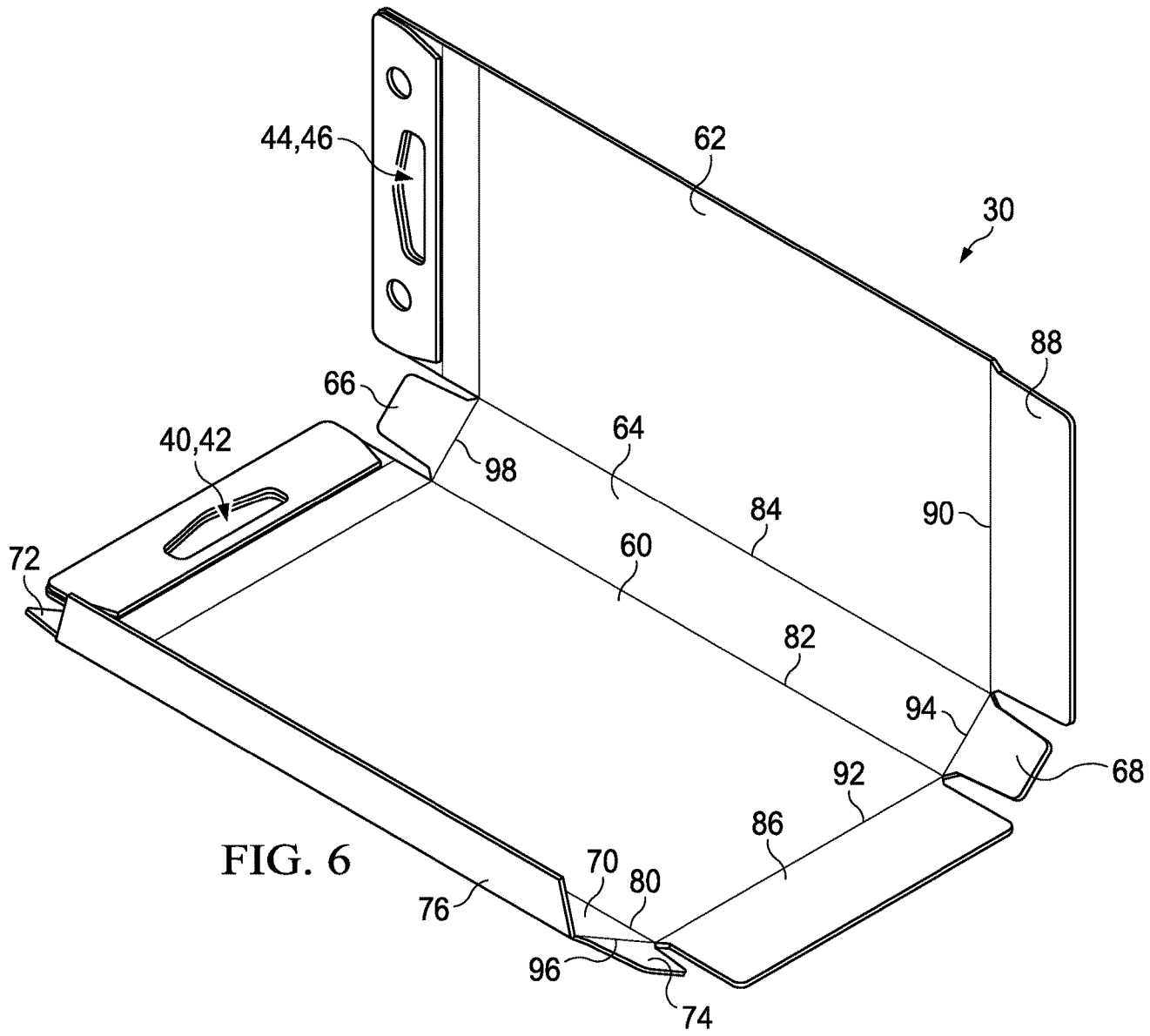
FIG. 6 is front view of the sheet of formable material in a folded position.

Referring to FIGS. 5 and 6, the sheet 30 may include a first panel 60 and a second panel 62. The second hang tag portion 34 may extend from the first panel 60 and the fourth hang tag portion 38 may extend from the second panel 62. A first side panel 64 may be positioned between the first panel 60 and the second panel 62. The first side panel 64 may include an upper tab 66 at one end and a lower tab 68 at another end. A second side panel 70 may extend from the first panel 60. The second side panel 70 may include an upper tab 72 at one end and lower tab 74 at another end. A side flap 76 may extend from the second side panel 70, thus the second side panel 70 may be positioned between the side flap 76 and the first panel 60.

Figure 7:
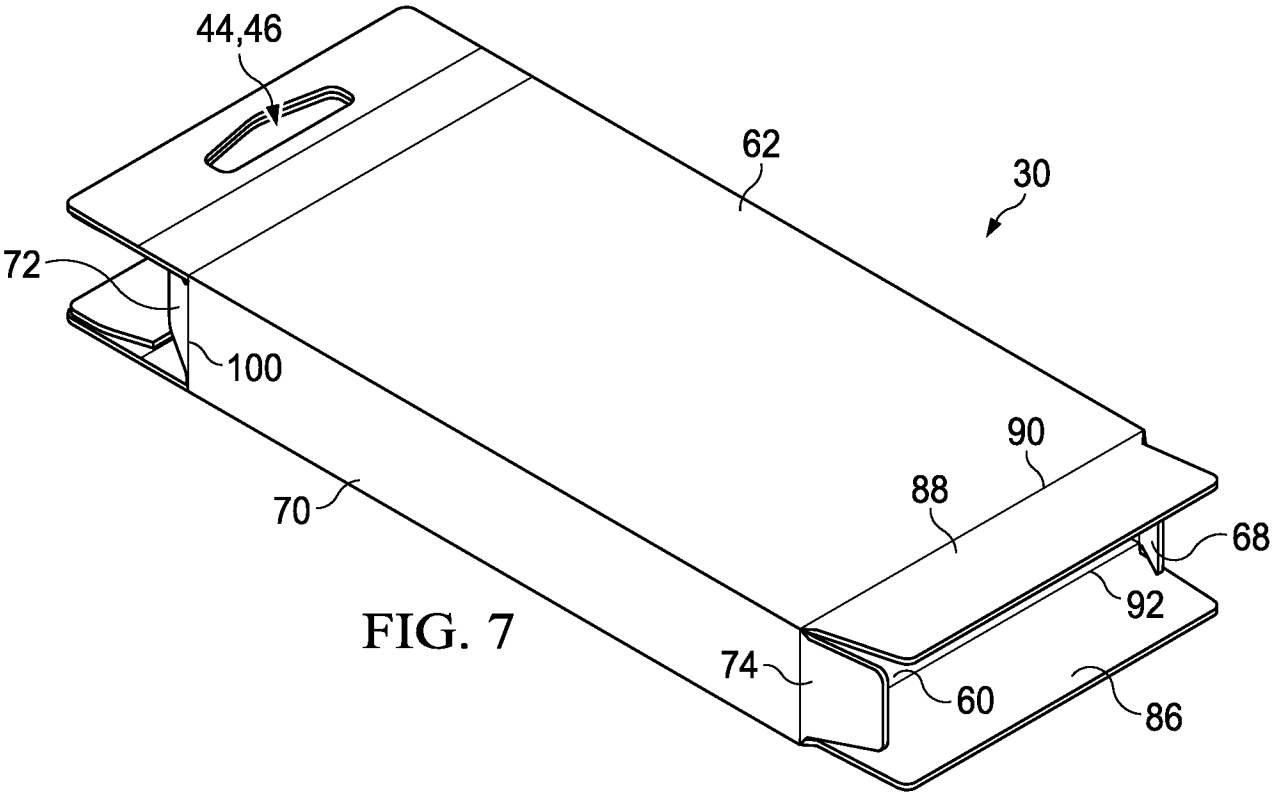
FIG. 7 is front view of the sheet of formable material in a folded position.

A fold line 78 may be positioned between the side flap 76 and the second side panel 70. A fold line 80 may be positioned between the second side panel 70 and the first panel 60. Accordingly, the side flap 76 may be folded toward the second side panel 70 and the second side panel 70 may be folded toward the first panel 60. A fold line 82 may be positioned between the first panel 60 and the first side panel 64. Accordingly, the first side panel 64 may be folded toward the first panel 60, as shown in FIG. 6. A fold line 84 may be positioned between the first side panel 64 and the second panel 62. Accordingly, the second panel 62 may be folded toward the first side panel 64, as shown in FIG. 6. The second panel 62 may be folded over to contact the side flap 76, as shown in FIG. 7. Thus, the side panel 70 of FIGS. 6 and 7 becomes the side face 26 of the consumer product package 10. Also, the second panel 62 of FIGS. 6 and 7 may become the front face 20 in the final assembled position, shown in FIG. 1A. Similarly, the first side panel 60 may become the rear face 22 in the final assembled position, shown in FIG. 1B.

Referring to FIGS. 6 and 7 first lower panel 86 may extend from the first panel 60 and a second lower panel 88 may extend from the second panel 62. A fold line 90 may be positioned between the second panel 62 and the second lower panel 88. A fold line 92 may be positioned between the first panel 60 and the first lower panel 86. A fold line 94 may be positioned between the tab 74 and the first side panel 64. A fold line 96 may be positioned between the tab 74 and the second side panel 70. The fold lines 94 and 96 may facilitate the folding of the respective tabs 68 and 74 downward (e.g., toward each other). The fold lines 90 and 92 may facilitate the folding of second lower panel 88 and the first lower panel 86, respectively. The first lower panel 86 and the second lower panel 88 may be folded over the tabs 68 and 74 to form the bottom face 18 (FIG. 1B).

Figure 8:
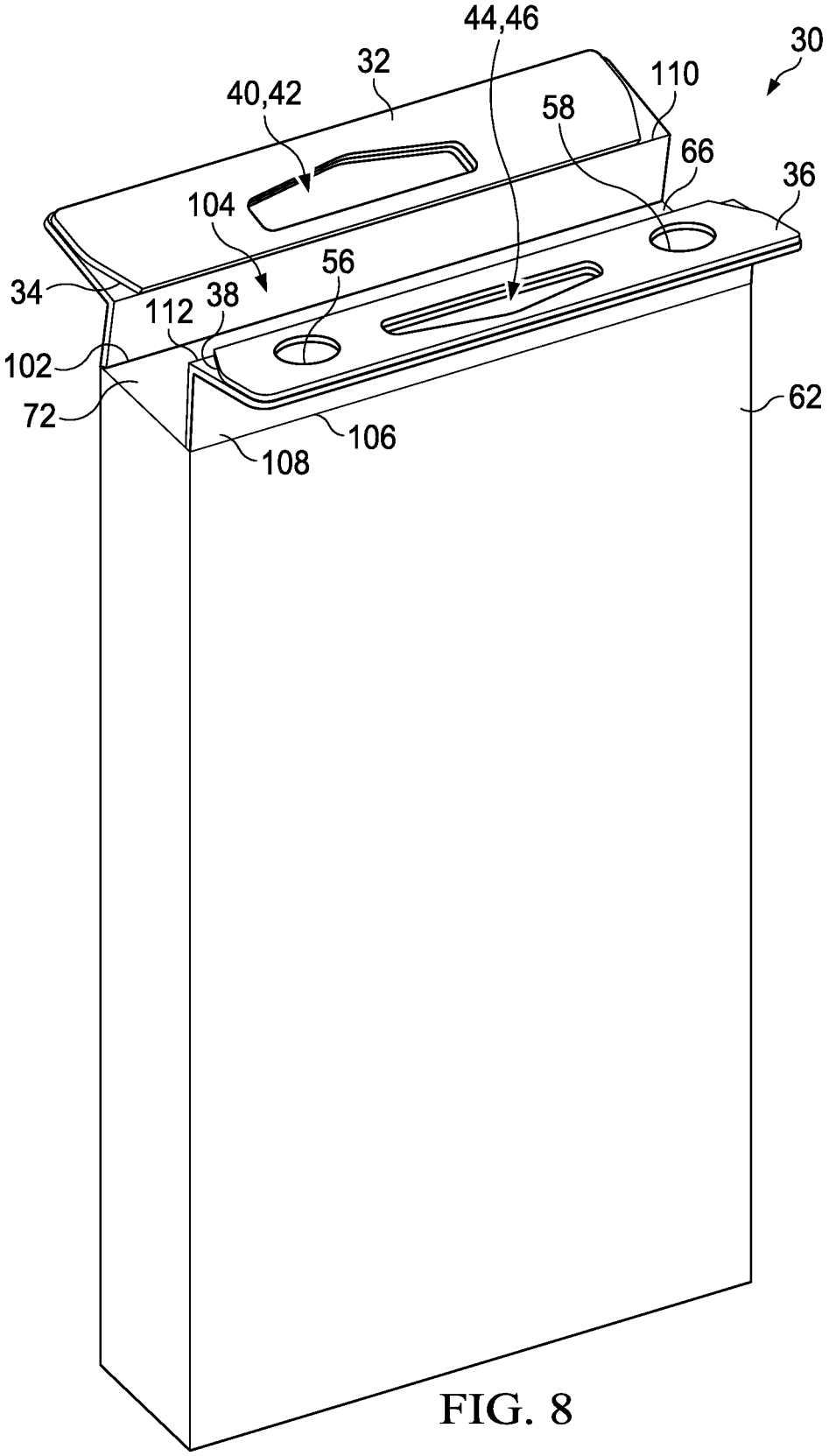
FIG. 8 is front view of the sheet of formable material in a folded position.
Figure 9:
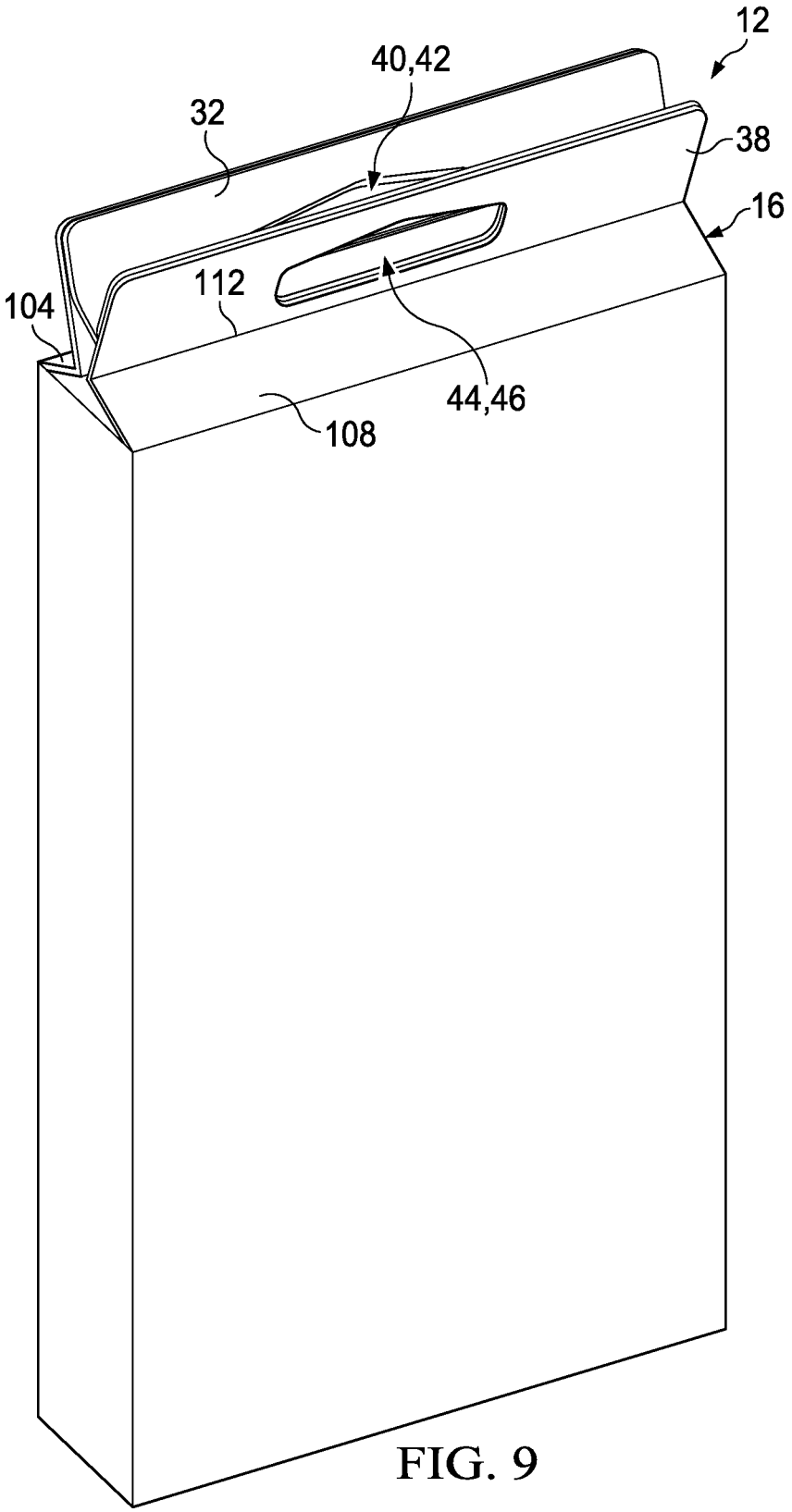
FIG. 9 is front view of the sheet of formable material in a folded position.

The tabs 66 and 72 may have respective fold lines 98 and 100, as shown in FIG. 5. The fold lines 98 and 100 may facilitate tabs 66 and 72 to be folded in, towards each other, as shown in FIGS. 7 and 8. The sheet 30 may have a fold line 102 between a first top side portion 104 and first panel 60. The sheet 30 may also have a fold line 106 between a second top side portion 108 and the second panel 62. The fold lines 102 and 106 may facilitate the first top side portion 104 and the second top side portion 108 to be folded in, towards each other, thus forming the top face 16 (FIG. 1A). For example, the first top side portion 104 may located on one side of the reinforced hang tag 12 and the second top side portion 108 may be located on the other side of the reinforced hang tag 12, as shown in FIG. 9. A fold line 110 may be positioned between the first top side portion 104 and the second hang tag portion 34. A fold line 112 may be positioned between the fourth hang tag portion 38 and the second top side portion 108, as shown in FIGS. 8 and 9. The fold lines 110 and 112 may facilitate the first and second hang tag portions 32 and 34 to be folded toward the third and fourth hang tag portions 36 and 38. It is understood that a product (not shown) may be inserted into the consumer product package 10 prior to folding the first and second hang tag portions 32 and 34 toward the third and fourth hang tag portions 36 and 38 and sealing them together. In certain embodiments, the first hang tag portion 32 may be sealed to the third hang tag portion 36 with adhesive. Adhesive may also be placed on the exposed areas 56 and 58 (FIG. 8) to facilitate the fourth hang tag portion 38 to be directly sealed to the first hang tag portion 32 to improve security and strength.

The resulting construction results in the consumer product package 10 of FIG. 1A. The single sheet 30 through a series of folding and sealing steps may result in the first hang tag portion 32 that defines first hang tag opening 40, the second hang tag portion 34 defining a second hang tag opening 42 and a third hang tag portion 36 defining a third hang tag opening 44 and a fourth hang tag portion 38 defining a fourth hang tag opening 46 that overlap in a folded position to form the reinforced hang tag 12. The third hang tag portion 36 and the second hang tag portion 34 may be positioned between the first hang tag portion 32 and the fourth hang tag portion 38. In the folded position the first hang tag opening 40, second hang tag opening 42, the third hang tag opening 44 and the fourth hang tag opening 46 may be aligned forming reinforced hang tag hole 14. It is understood the reinforced hang tag 12 (FIGS. 1A and 9) may include three, four, or more overlapping layers of the sheet 30, thus improving the strength of the hang hole 14.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm." Furthermore, dimensions should not be held to an impossibly high standard of metaphysical identity that does not allow for discrepancies due to typical manufacturing tolerances. Therefore, the term "about" should be interpreted as being within typical manufacturing tolerances.

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A consumer product package comprising:

a sheet of formable material with a first hang tag portion defining a first hang tag opening, a second hang tag portion defining a second hang tag opening and a third hang tag portion defining a third hang tag opening positioned between a pair of openings, a fourth hang tag portion having an exposed area with adhesive, wherein the sheet has a folded position with the first hang tag opening, the second hang tag opening and the third hang tag opening aligned and wherein the fourth hang tag portion is folded over the third hang tag portion with the exposed areas positioned within the respective pair of openings.

2. The consumer package of claim 1 wherein the second hang tag portion is positioned between the first hang tag portion and the third hang tag portion.

3. The consumer package of claim 1 wherein second hang tag portion is sealed to the first hang tag portion.

4. The consumer package of claim 3 wherein the third hang tag portion is sealed to the second hang tag portion.

5. The consumer package of claim 1 wherein the sheet comprises paperboard.

6. A sheet of formable material comprising:

a first hang tag portion defining a first hang tag opening;

a second hang tag portion defining a second hang tag opening;

a fold line between the first hang tag portion and the second hang tag portion;

a third hang tag portion defining a third hang tag opening positioned between a pair of openings defined by the third hang tag portion;

a fourth hang tag portion defining a fourth hang tag opening, the fourth hang tag portion having an exposed area within each of the openings in a folded position with the fourth hang tag portion folded over the third hang tag portion;

a fold line between the third hang tag portion and the fourth hang tag portion;

a first panel;

a second panel;

a first top side portion positioned between the second hang tag portion and the first panel;

a second top side portion positioned between the fourth hang tag portion and the second panel;

a fold line between the first top side portion and the first panel;

a fold line between the second top side portion and the second panel.

7. The sheet of claim 6 wherein the first hang tag has a folded position wherein the first hang tag portion is positioned against the second hang tag portion with the first hang tag opening aligned with the second hang tag opening.

8. The sheet of claim 6 further comprising adhesive on the exposed areas.

* * * * *